US006270018B1

(12) United States Patent
Kais et al.

(10) Patent No.: US 6,270,018 B1
(45) Date of Patent: Aug. 7, 2001

(54) TRACK OR METHOD FOR ALIGNING A RAIL TRACK SECTION

(75) Inventors: Alfred Kais, Eberstadt; Burkhard Zillien, Kirchgöns; Sebastian Benenowski, Butzbach, all of (DE)

(73) Assignee: BWG Butzbacher Weichenbau GmbH & Co. KG, Butzbach (DE)

( * ) Notice: Subject to any disclaimer, the term of this patent is extended or adjusted under 35 U.S.C. 154(b) by 0 days.

(21) Appl. No.: 09/147,703

(22) PCT Filed: Jun. 25, 1998

(86) PCT No.: PCT/EP98/03890

§ 371 Date: Feb. 22, 1999

§ 102(e) Date: Feb. 22, 1999

(87) PCT Pub. No.: WO99/01616

PCT Pub. Date: Jan. 14, 1999

(30) Foreign Application Priority Data

Jul. 1, 1997 (DE) ..... 197 27 797

(51) Int. Cl.[7] ..... E01B 13/00; E01B 5/00

(52) U.S. Cl. ..... 238/122; 238/125

(58) Field of Search ..... 238/122, 125; 246/435 R, 436

(56) References Cited

U.S. PATENT DOCUMENTS

| | | | | |
|---|---|---|---|---|
| 193,206 | * | 7/1877 | Ainsworth | 246/436 |
| 391,168 | * | 10/1888 | Mansfield | 246/436 |
| 4,965,940 | * | 10/1990 | Wilson | 238/122 |

* cited by examiner

*Primary Examiner*—S. Joseph Morano
*Assistant Examiner*—Robert J. McCarry, Jr.
(74) *Attorney, Agent, or Firm*—Dennison, Scheiner, Schultz & Wakeman

(57) ABSTRACT

The invention relates to a track with rail track section (10) which differs from the usual basic layout. In order to check changes in track layout in a simple manner, the invention provides that the rail track section (10) has a cutout (24) running parallel to the basic layout in a longitudinal direction of the track. When the rail track section is placed parallel to the basic layout, the layout of said cutout is inversely the same as that of the desired change in layout.

12 Claims, 3 Drawing Sheets

T > V, U > W

TRACK OR METHOD FOR ALIGNING A RAIL TRACK SECTION

The invention relates to a track having a rail track section diverging from the usual basic course, in particular a stock rail altered in its course by being led away from a track centerline. The invention further relates to a process for aligning a rail track section to a course alteration purposefully diverging from the basic course of the track, in particular for providing a course alteration for avoidance of an abrading movement between wheels of rolling stock traversing the track and the rail track section by changing the wheel contact point on the rail.

An array for controlled guidance of a wheel axis or bogie of rolling stock traversing a switch is known from EP 0 295 573 B1. To permit a substantially pure rolling movement between the wheel and the tail in the transition area between stock rail and tongue, while ensuring optimum travel comfort, it is proposed that at least the course of a stock rail in the area of the switch diverges from the basic course such that the wheel contact point is influenced effectively for a purposeful alignment of the wheel axis/bogie axis to the track longitudinal axis or median between main and secondary track in such a way that an abrading movement between wheel and rail is largely avoided. The purposeful course alteration is preferably achieved in that the stock rail is led away from the track center-line. The track center-line can here follow a straight or a curve if the switch itself is in the curve of a track. Depending on the curvature radius or length of the switch, the depth of the protrusion can be between 5 and 30 mm. Due to the minor divergence from the basic course, work must be with high precision to set the required course alteration and hence prevent an abrading movement between the wheel and the rail.

The problem underlying the present invention is to develop a track or process for aligning a rail track section of the type mentioned at the outset such that a precise alignment of the course of the rail track section can be checked with measures of simple design.

The problem is solved in accordance with the invention in that the rail track section has a cutout in the longitudinal direction of the track and parallel to the basic course of the latter whose course when the rail track section is arranged parallel to the basic course is inversely the same to the required course alteration.

In accordance with the invention, the rail track section to be subjected to a required course alteration is first aligned parallel to the basic course in order to then provide, for example by milling, a cutout such as a groove in the longitudinal direction, preferably in the rail head, and on that side opposite the running edge, the depth of which cutout varies depending on the required course alteration, namely following a curvature that runs opposite to that in the installed state of the rail track section. As a result of this, it is now necessary when installing the rail track section to have an alignment such that the cutout runs parallel to a measurement straight with its surface that is parallel to the running edge or rail web, the rail track section having undergone the required course alteration corresponding to the alignment of the reference surface of the cutout such as a groove bottom on a straight—or curve.

Since the cutout such as a groove has its greatest depth in the area of the required maximum course alteration, there should then be no limiting wall on the running surface side when this cutout is provided in the rail head, so that rail material cannot break out. Additionally and in a particularly noteworthy embodiment of the design, this cutout should rise in the direction of the rail head running surface as the groove depth increases.

In particular when the cutout runs in a rail head side flank, it is provided that it starts at the beginning of the course alteration of the rail track section approximately 10 to 20 mm, preferably 12 to 16 mm, in particular approximately 14 mm below the rail head running surface. In the area of the maximum course alteration of the rail track section, the cutout should have, in its limiting wall parallel to the rail web, a distance to the rail head running surface of 5 to 5.5 mm, based on a maximum course alteration relative to a basic course in the form of a straight of 10 to 20 mm.

Accordingly, the cutout permitting in simple manner a check of the required course alteration should be a step machined, for example milled, out of the rail head flank, said step having a side limiting surface that is vertical to the rail web and whose bottom surface running vertical or nearly vertical to the side limiting surface extends as far as the upper side of the rail head.

The process for aligning a rail track section of the type described above is characterized in accordance with the invention by the following process steps:

aligning of a rail track section parallel to the basic course, provision of a cutout in the rail track section, where the cutout runs with its bottom opposite to the required course alteration relative to the basic course, aligning of the section such that the cutout runs with its bottom parallel to the basic course, and fixing of the rail track section.

To permit simple checking as to whether the course alteration follows the required geometry, it is furthermore provided that along the rail track section a measurement straight is disposed parallel to the basic course, that the distance between the measurement straight and the cutout or its bottom running parallel to the central axis of the rail track section is measured for alignment of the rail track section to the required course alteration, and that the rail track section has the required course alteration when the distance between the measurement straight and the cutout or its bottom is constant over the entire length of the rail track section.

The following description and drawing show a preferred embodiment of the invention:

Figure 1:
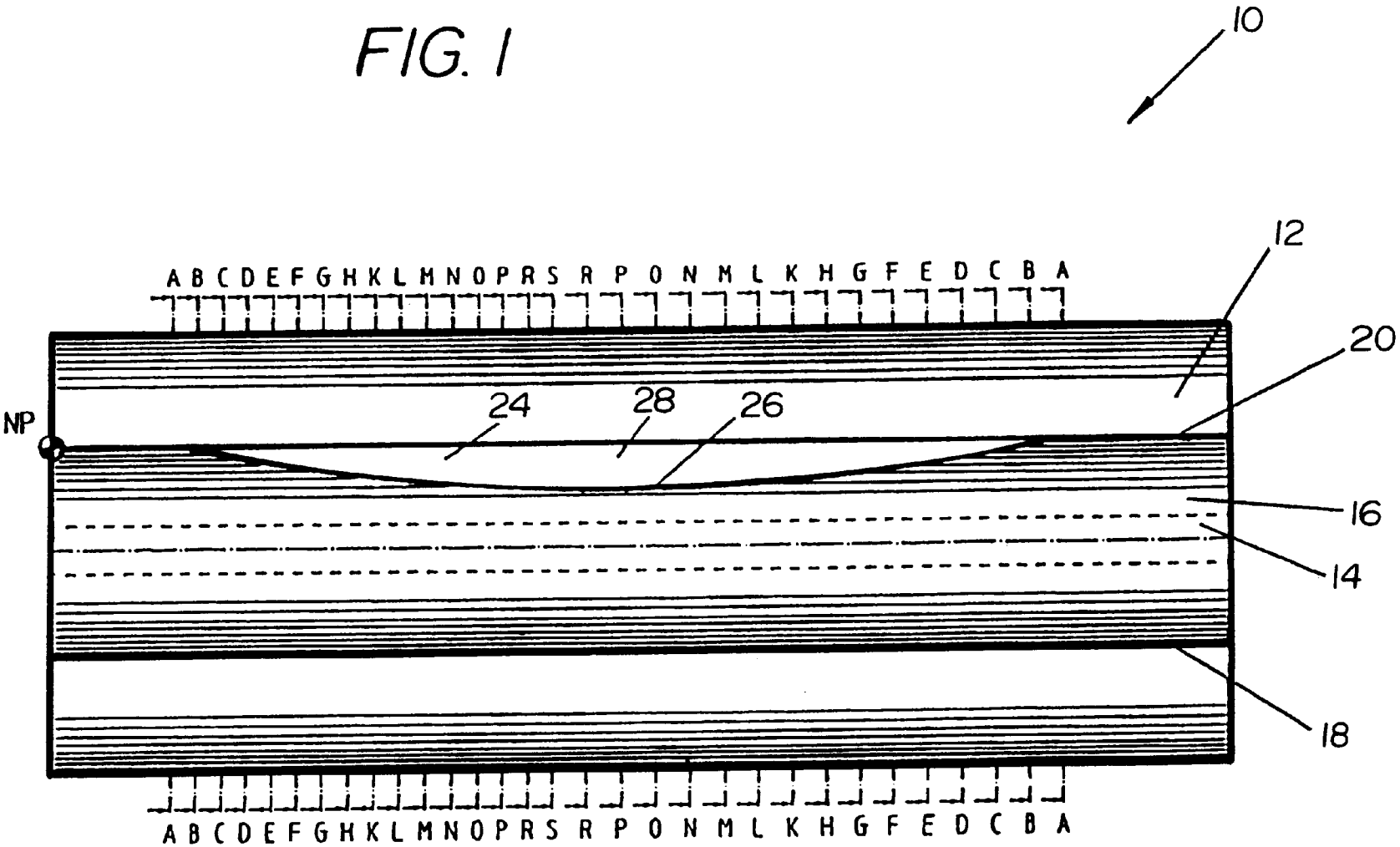
FIG. 1 shows a rail track section aligned with a normal basic course.

According to EP 0 295 573 B1, the wheel contact point of rolling stock traversing a track in the area of a switch can be influenced such that the stock rail undergoes a purposeful course alteration by being led away from the track centerline, thereby largely avoiding an abrading movement between wheel and rail. Appropriate course alterations can be in the range between 5 and 30 mm by protrusions in the stock rail. To ensure that the required course alteration of an appropriate rail track section such as a stock rail is precisely set, it is provided in the teachings in accordance with the invention that a rail track section 10 to be subjected to a course alteration is initially aligned parallel to the basic course, i.e. in particular to a straight. The corresponding rail track section 19 is shown in a plan view in FIG. 1. The rail foot 12, rail web 14 and rail head 15 with running surface 16 and its edges 18 and 20 can be seen. The edge 18 is the running edge in the installed state of the rail track section 10.

Figure 2:
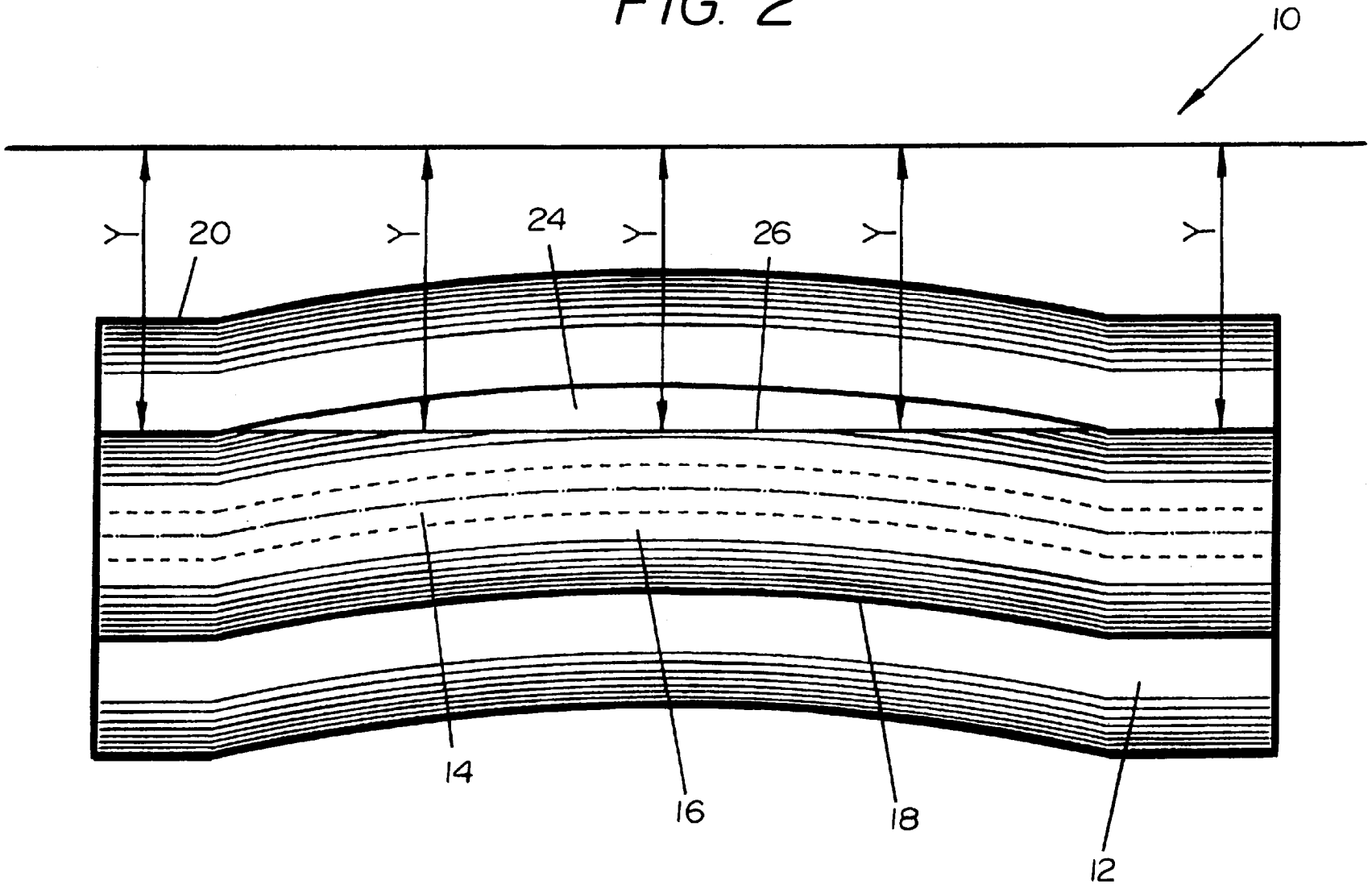
FIG. 2 shows the rail track section according to FIG. 1, but with changed course alteration.

To permit inspection of whether the rail track section 10 with the course alteration in the installed track diverges to the required extent from the basic course, a groove or step in the longitudinal direction of the rail track section 10 is machined, for example milled, in the rail head 15 on the side of the edge 20 in its second flank 22, with the bottom surface 26 of such groove running parallel to the rail central axis, i.e. parallel to the web 14, being provided with a curved course such that when the rail track section 10 in the embodiment is curved outwards (upwards in the drawing) the groove bottom 26 is aligned parallel to the usual basic course, as made clear by FIG. 2. In other words, the groove bottom 26 or a corresponding reference line in the case of the rail track section 10 following the basic course and the running edge 18 in the case of the rail track section 10 following the required course alteration are mirror-symmetrical to a straight running parallel to the basic course.

In other words, the cutout 24, i.e. its bottom 26, has in the case of the rail track section 10 aligned with the basic course a geometry that is inversely the same as the curved course of the rail track section 10 in accordance with FIG. 2.

If it is to be checked whether the rail track section 10 has the required course alteration, i.e. in a switch a stock rail has a protrusion outwards away from the switch tongue, all that is necessary is to arrange a measuring line parallel to the basic course and to check the distance between this line and the groove bottom 26. If the distance Y between the measuring line and the groove bottom 26 is equal, this ensures that the rail track section 10 has the required course alteration.

Since with increasing course alteration the depth of the groove 24 increases, it must be assured that the rail head does not break out in this area. It is therefore provided in accordance with the invention that the groove 24 rises towards the running surface 16 with increasing depth, as is made clear by the sectional views in FIGS. 3 to 5.

Figure 3:
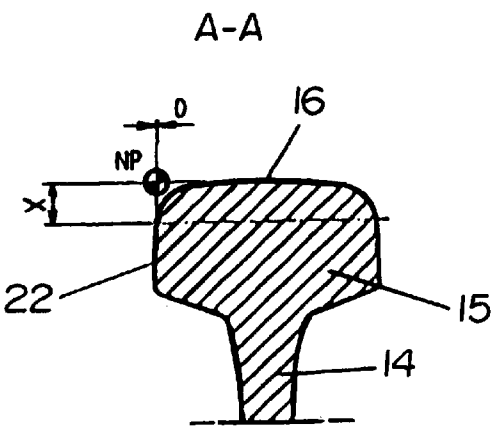
FIG. 3 shows a section along the line A—A in FIG. 1.

For example, FIG. 3 shows a section through the rail track section 10 in the area of the basic course that is not changed even after bending of the rail track section 10. As FIG. 3 makes clear, the rail head 15 has a normal geometry.

Figure 5:
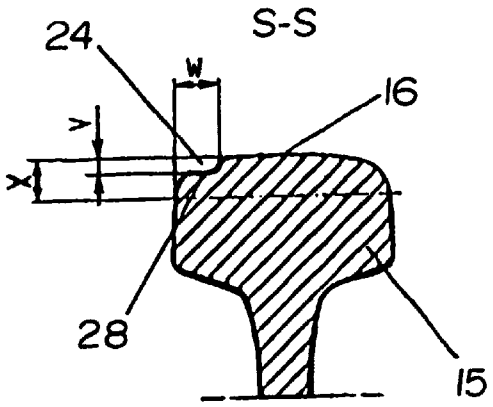
FIG. 5 shows a section along the line S—S in FIG. 1.
Figure 4:
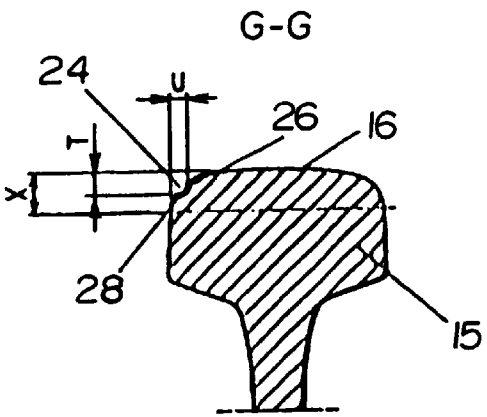
FIG. 4 shows a section along the line G—G in FIG. 1.

Relative to the intersection of running surface 16 and flank 22, the groove or step 24 is milled at a distance X from the zero point NP thus formed, where with increasing groove depth the distance from the zero point NP decreases, as made clear in FIGS. 4 and 5.

The distance T or V of the limiting surface 28 on the foot side vertical to the web 14 therefore decreases with increasing groove depth, while the distance U or W between side flank 22 and bottom 26 parallel to the web 14 from the rail head running surface increases.

What is claimed is:

1. A rail having a centerline and comprising first and second rail portions and a third rail portion between said first and second rail portions, the centerline of said first rail portion being collinear with the centerline of said second rail portion and the centerline of said third rail portion being curved, said third rail portion including a longitudinal cutout having an edge parallel to and spaced apart from the linear centerline of said first rail portion.

2. Rail according to claim 1, wherein the cutout (24) is a groove with groove side wall on the running surface side.

3. Rail according to claim 1 wherein the rail has a rail head having a side flank and wherein the cutout (24) is arranged in the rail head side flank.

4. Rail according to claim 3 wherein the cutout (24) starts at the junction of said first and third rail portions approximately 10 to 20 mm below the rail head running surface.

5. Rail according to claim 3 wherein the cutout (24) in the middle of the third portion runs at a distance below the rail head running surface of 5 to 5.5 mm the side wall (28) of the cutout being substantially vertical.

6. Rail according to claim 5, wherein the step (24) has a side limiting surface (28) that is vertical to the rail web (14) and a bottom surface (26) running parallel or nearly parallel to the rail web, said surface extending as far as the rail head running surface (16).

7. Rail according to claim 3, wherein the cutout (24) is a milled, into the rail head flank (22).

8. Rail according to claim 1 including a running edge (18) for guiding a flanged wheel and a second edge opposite said running edge and wherein said cutout 24 is formed along said second edge.

9. Rail according to claim 1 wherein the cutout (24) starts at the beginning of the course alteration of the rail track section (10) approximately 12 to 16 mm below the rail head running surface.

10. Rail according to claim 1 wherein the cutout (24) starts at the beginning of the course alteration of the rail track section (10) approximately 14 mm below the rail head running surface.

11. A rail according to claim 1 wherein the rail has a longitudinal axis, the groove has a width and a depth, and wherein said width and depth vary in the direction of said longitudinal axis.

12. A method of altering the course of a rail track section comprising the steps of:

providing a linear section of rail track having a centerline and first and second longitudinal side edges;

selecting a first portion of said linear rail section for making a course correction;

determining a desired curvature for said centerline along said first portion;

making along said first portion a longitudinal cutout having an edge with a curvature inverse to said desired curvature; and, bending said first portion until said cutout edge is parallel to the linear centerline of said rail track.

* * * * *